United States Patent [19]

Cheong et al.

[11] 4,346,757

[45] Aug. 31, 1982

[54] AUTOMOTIVE COOLING SYSTEM USING A NON-PRESSURIZED RESERVOIR BOTTLE

[75] Inventors: Alex S. Cheong, Mississauga; James F. Accursi, Windsor, both of Canada

[73] Assignee: Borg-Warner Corporation, Chicago, Ill.

[21] Appl. No.: 185,828

[22] Filed: Sep. 10, 1980

[51] Int. Cl.[3] ..... F01P 3/00

[52] U.S. Cl. ..... 165/51; 165/104.32; 165/DIG. 24; 123/41.27; 123/41.44

[58] Field of Search ..... 165/51, DIG. 24, 104.32; 123/41.01, 41.2, 41.27, 41.44, 41.54

[56] References Cited

U.S. PATENT DOCUMENTS

| | | | |
|---|---|---|---|
| 1,079,320 | 11/1913 | Baker | 123/41.44 |
| 1,677,981 | 7/1928 | Muir | 123/41.21 |
| 1,700,270 | 1/1929 | Muir | 123/41.44 |
| 2,531,335 | 11/1950 | Harvey | 123/41.44 |
| 2,656,825 | 10/1953 | Hartz | 123/41.44 |
| 3,051,450 | 8/1962 | White et al. | 165/110 |
| 3,234,884 | 2/1966 | Gearn | 123/41.44 |
| 3,254,707 | 6/1966 | Ferguson | 165/110 |
| 3,256,868 | 6/1966 | Gratzmuller | 123/41.44 |
| 3,576,181 | 6/1969 | Neal et al. | 123/41.51 |
| 3,623,462 | 11/1971 | Anders et al. | 123/41.54 |
| 3,989,103 | 11/1976 | Cieszko et al. | 165/110 |

*Primary Examiner*—Albert W. Davis
*Assistant Examiner*—Margaret A. Focarino
*Attorney, Agent, or Firm*—James A. Geppert

[57] ABSTRACT

An automotive vehicle cooling system having a radiator connected to the engine coolant jacket for circulation of coolant, a pump delivering coolant from the radiator to the engine, a non-pressurized reservoir bottle communicating with the radiator and having a make-up line communicating with a venturi in a recirculating line around the pump directing coolant from the pump outlet to the pump inlet. The venturi allows make-up coolant to be added from the reservoir bottle at atmospheric pressure so that the bottle can be of a relatively light-weight gauge material.

6 Claims, 4 Drawing Figures

AUTOMOTIVE COOLING SYSTEM USING A NON-PRESSURIZED RESERVOIR BOTTLE

BACKGROUND AND SUMMARY OF THE INVENTION

Substantially all of today's automotive cooling systems utilize a surge bottle or reservoir connected to an overflow conduit from the radiator. The surge tank or reservoir provides for storage of a quantity of coolant required to automatically replace any coolant lost during operation of the system, and as the coolant is heated, it expands in volume, with the expanded fluid being accommodated in the reservoir or surge bottle. As some vehicles, specifically heavy duty trucks or buses, use a pressurized bottle, the bottle is subjected to a positive system pressure, and is formed of a metal or heavy plastic. The present invention relates to an arrangement to depressurize the surge bottle so that a lighter weight material can be utilized in forming the bottle for either car or truck applications.

The present invention comprehends the provision of a lightweight material depressurized surge bottle or reservoir in a coolant system for an automotive vehicle engine. To maintain the reservoir or surge bottle at atmospheric pressure, a venturi is located in a by-pass for the coolant pump to recirculate a small portion of the coolant flow from the pump outlet to the pump inlet. The venturi throat is connected with the surge bottle through a make-up line.

The present invention also comprehends the provision of an automotive coolant system which provides a controlled coolant flow system through a depressurized surge bottle. Thus, when the coolant system pressure increases to a predetermined value due to coolant expansion, the coolant will flow through the overflow tube from the radiator to the surge bottle, and this amount of coolant plus any amount necessary to fill the system will be drawn through the make-up line due to the low pressure created in the venturi throat.

The present invention further comprehends the provision of an automotive coolant system having a continuous controlled coolant flow system, wherein a controlled capillary tube may replace or be used simultaneously with the overflow tube from the radiator, maintained at a positive pressure, to the surge bottle at atmospheric pressure. This capillary tube is designed to have a pressure drop substantially equal to the pressure differential between the pressurized coolant system and atmosphere. This will provide an effective deaeration of the cooling system wherein gas leakage is present through the cylinder head gasket. The entrapped gas is continuously moved through the system to the reservoir where the gas can escape.

The present invention also comprehends the provision of an automotive cooling system wherein a continuous controlled coolant flow through the reservoir permits the placement of a sensor or corrosion inhibitor package or membrane for a package in the reservoir to be in contact with coolant flow at all times. When the inhibitor concentration in the coolant decreases, the sensor will generate a signal or the membrane or package will corrode and break open to release additional inhibitor into the coolant system.

The present invention also provides an automotive coolant system having a venturi in a recirculation conduit around the coolant pump and connected through a make-up line to the surge bottle at atmospheric pressure with a one-way or check valve located in the make-up line to prevent back flow to the surge bottle and maintain a positive pressure in the coolant system.

Further objects are to provide a construction of maximum simplicity, efficiency, economy and ease of assembly and operation, and such further objects, advantages and capabilities as will later more fully appear and are inherently possessed thereby.

DESCRIPTION OF THE PREFERRED EMBODIMENT

Figure 1:
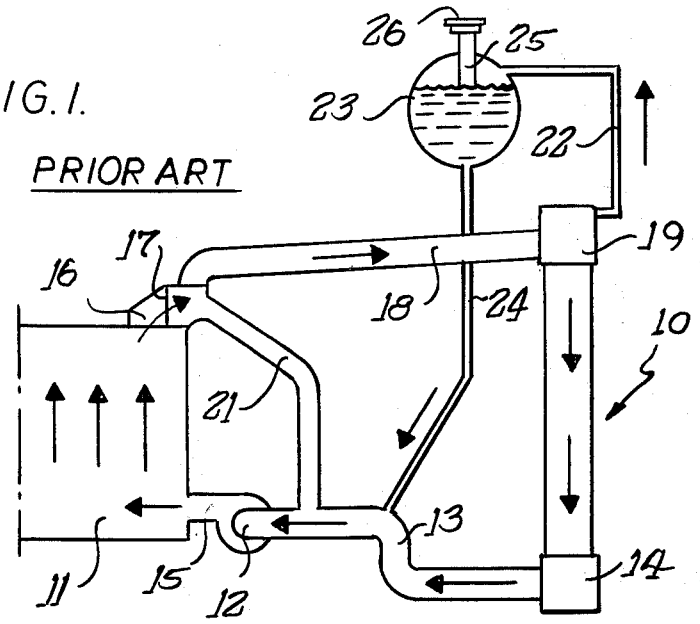
FIG. 1. PRIOR ART
FIG. 1 is a schematic view of a conventional automotive coolant system employing a downflow radiator.
Figure 2:
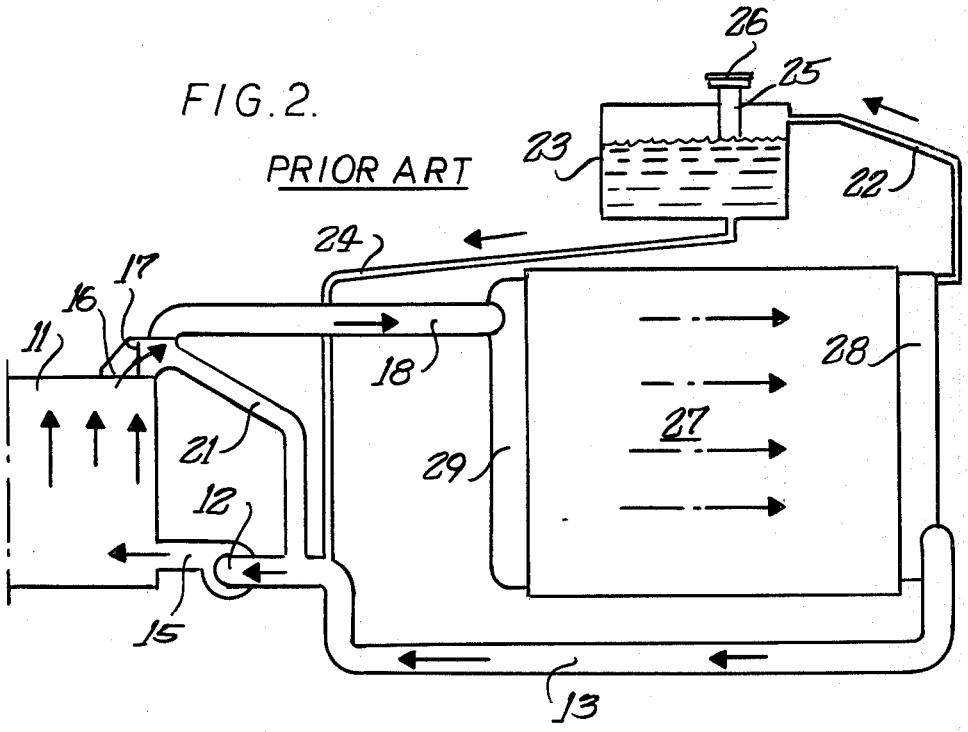
FIG. 2. PRIOR ART
FIG. 2 is a schematic view similar to FIG. 1 but showing a crossflow radiator.

Referring more particularly to the disclosure in the drawings wherein is shown the illustrative embodiment of the present invention, FIGS. 1 and 2 disclose conventional automotive coolant systems for a downflow radiator 10 and a crossflow radiator 27; like parts of these systems having identical reference numerals. In each system, an automotive engine 11 requires cooling during operation by the circulation of a suitable coolant through the engine block coolant jacket. The coolant is circulated by a coolant pump 12 driven by the engine and receiving coolant through the outlet conduit 13 from the lower tank 14 of the radiator 10 or the outlet side tank 28 of the crossflow radiator 27. A conduit 15 leads from the pump 12 to the coolant jacket of the engine 11, and an outlet 16 from the engine houses a thermostat 17 to be actuated at a predetermined temperature level.

A third or inlet conduit 18 controlled by the thermostat leads from the engine 11 to the upper tank 19 of downflow radiator 10 or the inlet side tank 29 of the crossflow radiator 27. A by-pass conduit 21 extends between the chamber housing the thermostat 17 and the conduit 13 upstream of the pump. An overflow conduit 22 leads from the upper tank 19 or side tank 28 to a surge bottle or reservoir 23. A make-up line 24 leads from the reservoir 23 to the conduit 13. As the system is under pressure the reservoir has an inlet 25 with a pressure cap 26.

The system is normally filled with a suitable coolant with the surge bottle or reservoir 23 having a minimum level. When the engine is cold, the thermostat 17 is closed preventing flow to the radiator 10 or 27. Operation of the engine causes the pump 12 to circulate coolant through the coolant jacket of the engine 11 and the by-pass conduit 21 to return to the pump through conduit 13. As the coolant warms up, the temperature level is exceeded to open the thermostat 17 and allow circulation through the radiator 10 or 27 to cool the hot fluid from the engine jacket. The pump provides a pressure level in the system and, as the coolant increases in temperature from the hot engine, the coolant expands in volume and flows through the overflow conduit 22 into the surge tank or reservoir 23. Likewise, the reservoir supplies fluid to the system during operation and when the fluid contracts as the system cools upon termination of engine operation. The pressure cap 26 in the reservoir will vent the system if the pressure becomes excessive.

Figure 3:
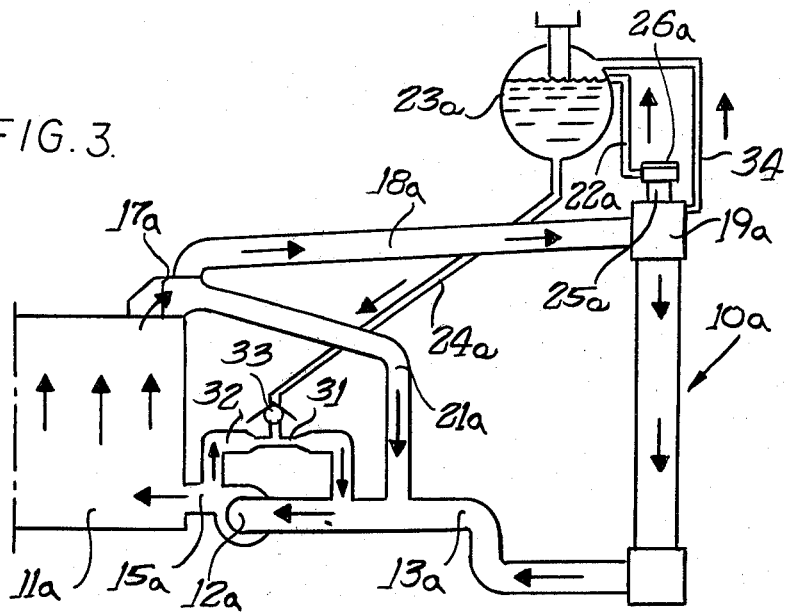
FIG. 3 is a schematic view of an automotive coolant system with a downflow radiator and employing the present invention therein.
Figure 4:
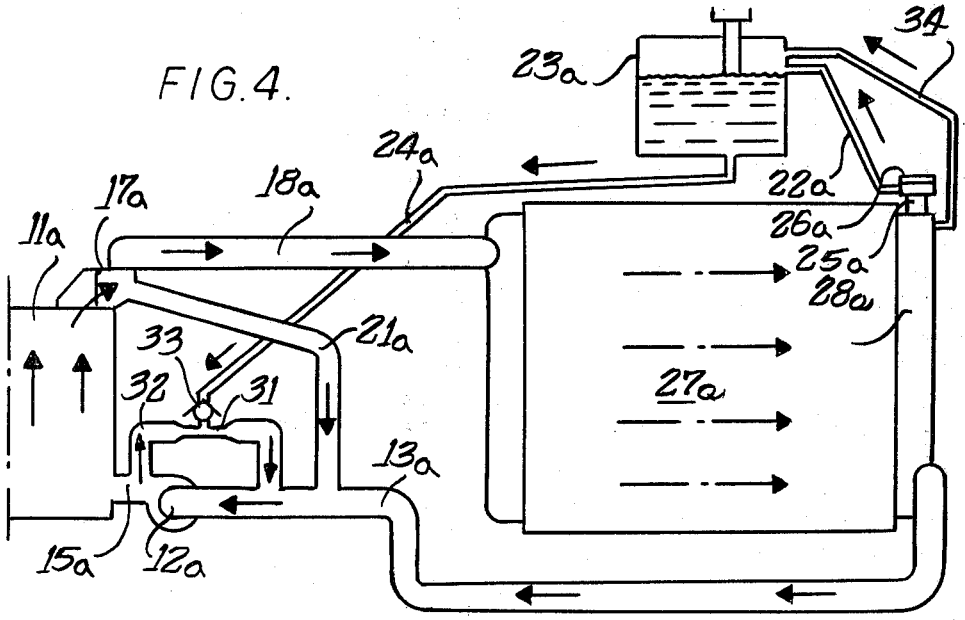
FIG. 4 is a schematic view of an automotive coolant system having a crossflow radiator and employing the present invention.

FIGS. 3 and 4 disclose the same coolant systems shown in FIGS. 1 and 2, but employing a surge bottle at atmospheric pressure; and like parts will have the same reference numerals as those in FIGS. 1 and 2 with a script a. In this arrangement, the coolant system will be pressurized, however, the surge bottle or reservoir 23*a* will remain at atmospheric pressure. To allow the depressurized reservoir and still provide feed of coolant from the reservoir, a venturi 31 in a conduit 32 around the pump 12*a* allows a small portion of coolant flow from the conduit 15*a* to return to conduit 13*a* upstream of the pump 12*a*. The make-up line 24*a* communicates between the throat of the venturi 31 and the reservoir 23*a*. A one-way or check valve 33 is located in the line 24*a* to prevent backup of coolant to the reservoir.

A controlled capillary tube 34 may replace or be used simultaneously with the overflow tube 22*a* by connecting the radiator tank 19*a* or 28*a* at positive pressure with the surge bottle 23*a* at atmospheric pressure. This capillary tube is designed to have a pressure drop substantially equal to the pressure differential between the pressurized coolant system and the atmosphere. The use of the capillary tube provides a continuous coolant flow to the surge bottle with circulation through the radiator. As the coolant system is pressurized, the radiator tank 19*a* or 28*a* is provided with a fitting 25*a* and a pressure cap 26*a*.

The operation of the present invention is similar to that for the conventional coolant system shown in FIGS. 1 and 2. Operation of the pump 12*a* causes circulation of the coolant through the coolant jacket of the engine 11*a* and the by-pass 21*a* until the thermostat 17*a* opens. Then flow proceeds through inlet conduit 18*a* and the radiator 10*a* or 27*a* where the hot fluid is cooled and returned to the pump through outlet conduit 13*a*. During operation of the pump 12*a*, a small portion of coolant passes through the line 32 and venturi 31 to return to conduit 13*a*. As the coolant increases in temperature during operation of the system, the fluid expands and enters the surge bottle 23*a* through the overflow conduit 22*a*. This amount of coolant plus any necessary to retain the system full will be drawn through the make-up line 24*a* from the surge bottle 23*a* at atmospheric pressure by the low pressure created in the venturi throat.

To replenish the coolant supply in the surge bottle and to have a continuous coolant flow, coolant under pressure passes continuously through the capillary tube 34 where the tube is substituted for the overflow conduit or simultaneously with flow through the overflow conduit 22*a* from the radiator tank 19*a* or 28*a*. Also, at engine shut-down, there is a local rise in coolant temperature at the engine block coolant jacket. This could result in local boiling and cause the coolant to flow back to the surge bottle 23*a*, which is at atmospheric pressure as a result of introducing the venturi into the system. To prevent this, the check valve 33 is positioned in the make-up line 24*a* to prevent back-flow by maintaining a positive pressure in the system.

We claim:

1. In a pressurized cooling system for an automotive vehicle including an engine coolant jacket, a radiator, a coolant pump directing fluid from the radiator to the engine coolant jacket, a surge bottle connected to an overflow line from the radiator, and a make-up line from the surge bottle to a point upstream of the pump, the improvement comprising a conduit from the pump outlet to the pump inlet, and a venturi in said conduit with the venturi throat connected to said make-up line, such that the surge bottle is maintained at atmospheric pressure.

2. A coolant system as set forth in claim 1, wherein a check valve is located in said make-up line to prohibit back flow to said surge tank.

3. A coolant system as set forth in claim 1, in which a capillary tube communicates between said radiator and said surge bottle to promote a continuous coolant flow through said surge bottle.

4. A coolant system as set forth in claim 3, in which the pressure drop of said capillary tube is substantially equal to the pressure differential between the pressure in the system and atmospheric pressure.

5. A coolant system as set forth in claim 3, in which said capillary tube replaces said overflow tube.

6. A coolant system as set forth in claim 3, in which said capillary tube is used simultaneously with said overflow tube.

* * * * *